US008905451B1

(12) United States Patent
Golz

(10) Patent No.: US 8,905,451 B1
(45) Date of Patent: Dec. 9, 2014

(54) RESCUE SLING AND METHOD OF CONSTRUCTION

(75) Inventor: Robert E. Golz, Swansea, MA (US)

(73) Assignee: Murdock Webbing Co., Ltd., Central Falls, RI (US)

( * ) Notice: Subject to any disclaimer, the term of this patent is extended or adjusted under 35 U.S.C. 154(b) by 183 days.

(21) Appl. No.: 13/558,150

(22) Filed: Jul. 25, 2012

(51) Int. Cl.
*A61G 1/00* (2006.01)

(52) U.S. Cl.
USPC ..... 294/140; 5/621; 5/624; 119/857

(58) Field of Classification Search
USPC ..... 294/140, 74; 182/3; 119/857; 244/151 R; 5/89.1, 621, 622, 623, 624
See application file for complete search history.

(56) References Cited

U.S. PATENT DOCUMENTS

| | | | | | |
|---|---|---|---|---|---|
| 2,663,031 | A | * | 12/1953 | Kalthoff | 5/89.1 |
| 4,834,439 | A | * | 5/1989 | van de Kamp | 294/74 |
| 5,219,636 | A | * | 6/1993 | Golz | 294/74 |
| 5,419,951 | A | | 5/1995 | Golz | |
| 5,564,476 | A | | 10/1996 | Golz | |
| 5,677,056 | A | | 10/1997 | Golz | |
| 5,697,329 | A | * | 12/1997 | Bell et al. | 119/857 |
| 5,699,836 | A | | 12/1997 | Golz | |
| 6,331,024 | B1 | * | 12/2001 | Gulley | 294/74 |
| 6,375,241 | B1 | * | 4/2002 | Sadeck | 294/75 |
| 6,390,143 | B1 | * | 5/2002 | Speich | 139/1 R |
| 6,450,131 | B1 | * | 9/2002 | Broman | 119/857 |
| 6,824,346 | B2 | * | 11/2004 | Coblentz | 414/803 |
| 6,953,064 | B2 | | 10/2005 | Golz | |
| D602,638 | S | | 10/2009 | Dempsey | |
| 7,628,180 | B1 | | 12/2009 | Golz | |
| 7,628,435 | B1 | | 12/2009 | Golz | |
| 7,891,717 | B2 | | 2/2011 | Golz | |

* cited by examiner

*Primary Examiner* — Paul T Chin
(74) *Attorney, Agent, or Firm* — Salter & Michaelson

(57) ABSTRACT

A rescue sling that includes multiple elongated webbing sections including contiguous alternating slotted and non-slotted webbing sections. One of the slotted webbing sections forms a handle opening meant to be grasped by a rescuer, and at least two other slotted webbing sections oppositely coupled from the one slotted webbing section and forms respective retaining openings for receiving therethrough limbs of one being rescued. Two additional slotted webbing sections are disposed distally of the respective at least two slotted webbing sections and form respective additional retaining openings for receiving therethrough additional limbs of the one being rescued.

27 Claims, 5 Drawing Sheets

RESCUE SLING AND METHOD OF CONSTRUCTION

FIELD OF THE INVENTION

The present invention relates in general to a rescue sling and pertains mot=re particularly to an improved rescue sling and webbing intended to be used as a one piece fire proof and cut resistant rescue sling. The present invention also relates to the webbing, the method of making the webbing and products made from the webbing in constructing a rescue sling.

BACKGROUND OF THE INVENTION

Rescue slings currently on the market are used to pull, drag or lift an individual out of harms way, possibly in such situations as rescue from a burning building, in a natural disaster or any situation that warrants quickly getting an individual to a safe location. Some of these rescue slings may be called military rescue slings, combat rescue slings, or fire or firefighter rescue slings.

Rescue slings are designed by a multitude of different manufactures to their specific criteria such as strength rating, length, width, thickness and color. Most rescue type slings are manufactured from flat webbing products, usually made using nylon, polyester or polypropylene yarns. Rescue slings are configured in many different ways. Some are constructed with buckles which are sewn into a flat webbing product, wherein the buckles must be connected to be used for a rescue. Other rescue slings use no hardware and are sewn together. One such product is called a Sling Link Combat rescue sling manufactured by Sling Link, Inc. and schematically identified in FIG. 1 herein.

The Sling Link product is made using five separate webbings, sections or loops that are typically provided in different colors, and that are looped together. Refer to design patent D602,638 owned by Sling Link, Inc. The combat rescue version uses one length of green webbing, two lengths of brown webbing and two lengths of black webbing. The color coding sequence of each of the components is important in a rescue situation for ease of use. All the components are woven with nylon 6 PET collar webbing. Each component is approximately 57 inches in length and formed into a loop as shown in FIG. 1.

FIG. 1 illustrates a typical rescue sling A which shows the five above mentioned sections identified as sections or loops 7A, 7B, 7C, 7D and 7E, with corresponding stitching or sewing identified respectively at 8A, 8B, 8C, 8D and 8E joined through one another in the three different colors of black 9A, brown 9B and green 9C.

This rescue sling is formed from separate webbing sections in a predetermined sequence to form the basis of what is called a rescue sling. The first length of webbing is black in color. The 57 inch length section 7A of black webbing is formed into a circle overlapping the two heat sealed bitter ends at approximately 9 inches in length and sewn together (loop or section 7A sewn at 8A). The diameter of the circle formed by the webbing is approximately 15 inches. The next 57 inch section 7B of webbing is brown in color. This is threaded through the circle formed of black webbing, over lapped by the same 9 inches and stitched together to form a second length of webbing (loop or section 7B sewn at 8B). The next 57 inch section 7C of webbing is green in color, and is the only green loop. The green webbing is threaded through the circle formed of brown webbing, overlapped by 9 inches and stitched together to form a third circle or loop that may be 15 inches in diameter (loop or section 7C sewn at 8C).

Another 57 inch section 7D of brown webbing is attached to the green circle in the same manner, completing four lengths of webbing threaded together (loop or section 7D sewn at 8D). The final length section 7E of webbing is black in color and is thread through the fourth circle of brown webbing, over lapped by the same length and sewn together (loop or section 7E sewn at 8E). The completed unit is thus comprised of five separate circles of webbing interlocked together, and as illustrated in FIG. 1 herein.

Rescue slings manufactured using the Sling Link method, although having been commercially used are characterized by a very labor intensive and costly method of fabrication. The organization Web Sling and Tie Down Association recommend a safety factor of ⅓ be used as a Working Load Limit. This safety factor takes into account the effect of sewing on the original strength of the webbing used to fabricate slings made of synthetic webbing. The webbing used to manufacture the Sling Link rescue sling can be rated at 4,000 pounds. Thus, the recommended Working Load Limit would be ⅓ of 4,000 pounds or 1,333 pounds in a vertical configuration. Further improvement of the methodology of manufacture and strength improvement is always to be sought.

Accordingly, it is an object of the present invention to provide an improved method of manufacturing a rescue sling.

Another object of the present invention is to provide an improved integrally woven one piece flame resistant rescue sling.

Still another object of the present invention is to provide an improved rescue sling that can be manufactured far easier and at less expense in comparison to existing rescue slings.

SUMMARY OF THE INVENTION

To accomplish the foregoing and other objects, features and advantages of the present invention there is provided a rescue sling comprising multiple elongated webbing sections including contiguous alternating slotted and non-slotted webbing sections. One of the slotted webbing sections forms a handle opening meant to be grasped by a rescuer, and at least two other slotted webbing sections oppositely coupled from the at least one slotted webbing section and forming respective retaining openings for receiving therethrough limbs of one being rescued.

In accordance with other aspects of the present invention there are two additional slotted webbing sections disposed distally of the respective at least two slotted webbing sections and forming respective additional retaining openings for receiving therethrough additional limbs of the one being rescued; the slotted webbing sections are color coded; each of the sections of slotted webbing is comprised of separated webbing pieces that each have an inside surface and an outside surface; wherein, for each webbing piece of a webbing section, the colors differ on the respective inside and outside surface thereof; the outside surface of the at least two other slotted webbing sections has a different color to that of the outside surface of the two additional slotted webbing sections; the different colors are red and yellow; the inside surface of the at least two other slotted webbing sections has a different color to that of the inside surface of the two additional slotted webbing sections; a top piece is woven using a 3 up 1 down weave and a 1 up 3 down weave without reference to a bottom piece, the top piece is woven with ½ of the total number of yarns showing just on the top face of the webbing, and the bottom face of the top piece is woven with ½ of the total number of ends showing just on the bottom face of the top piece; a bottom piece is also woven using a 3 up 1 down weave and a 1 up 3 down weave without reference to the top piece; the bottom piece is woven with the other half of the total number of ends showing just on the top face of the webbing; and the bottom face of the bottom piece is woven with the other half of the ends showing just on the bottom face of the bottom piece; each non-slotted section is comprised of an interlocking two-ply weave; the non-slotted section is comprised of black solution dyed yarns weave along both edges and with red and yellow yarns weaving the body of the webbing; and the handle opening is smaller than the retaining openings.

In accordance with the present invention there is provided a rescue sling comprising: a first non-slotted webbing section; a second slotted webbing section; a third non-slotted webbing section; a fourth slotted webbing section; a fifth non-slotted webbing section; a sixth slotted webbing section; a seventh non-slotted webbing section; an eighth slotted webbing section; a ninth non-slotted webbing section; a tenth slotted webbing section; and an eleventh non-slotted webbing section.

In accordance with other aspects of the present invention each of the sections of slotted webbing is comprised of separated webbing pieces that each have an inside surface and an outside surface; the slotted webbing sections are color coded; wherein, for each webbing piece of a webbing section, the colors differ on the respective inside and outside surface thereof; the outside surface of the second slotted webbing section has a different color to that of the outside surface of the fourth slotted webbing section; the inside surface of the second slotted webbing section has a different color to that of the inside surface of the fourth slotted webbing sections; the second, fourth, eighth and tenth webbing sections form respective retaining openings for receiving therethrough limbs of one being rescued, and the sixth webbing section forms a handle opening meant to be grasped by a rescuer.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

The present invention relates to an improved method of manufacturing a rescue sling and an associated improved rescue sling. The present invention is in the form of an integrally woven one piece flame resistant rescue sling. An integral woven slotted webbing is used and is preferably constructed in 11 distinct sections. The webbing can be manufactured on a shuttle type loom or a shuttless type loom. The yarn used to weave the webbing is made up of continuous filament solution dyed Kevlar 29 yarn in 3 different colors. The colors selected are yellow, red and black, although other color combinations can be used. The denier used for the warp yarns are 1500/2 and denier for the filling yarns are 1500/1. The purpose of the solution dyed yarn is to be able to readily identify each section with a color and pattern change. This is important in providing instant information to the rescuer as to where the different parts of the sling are to engage the individual being rescued.

Figure 1:
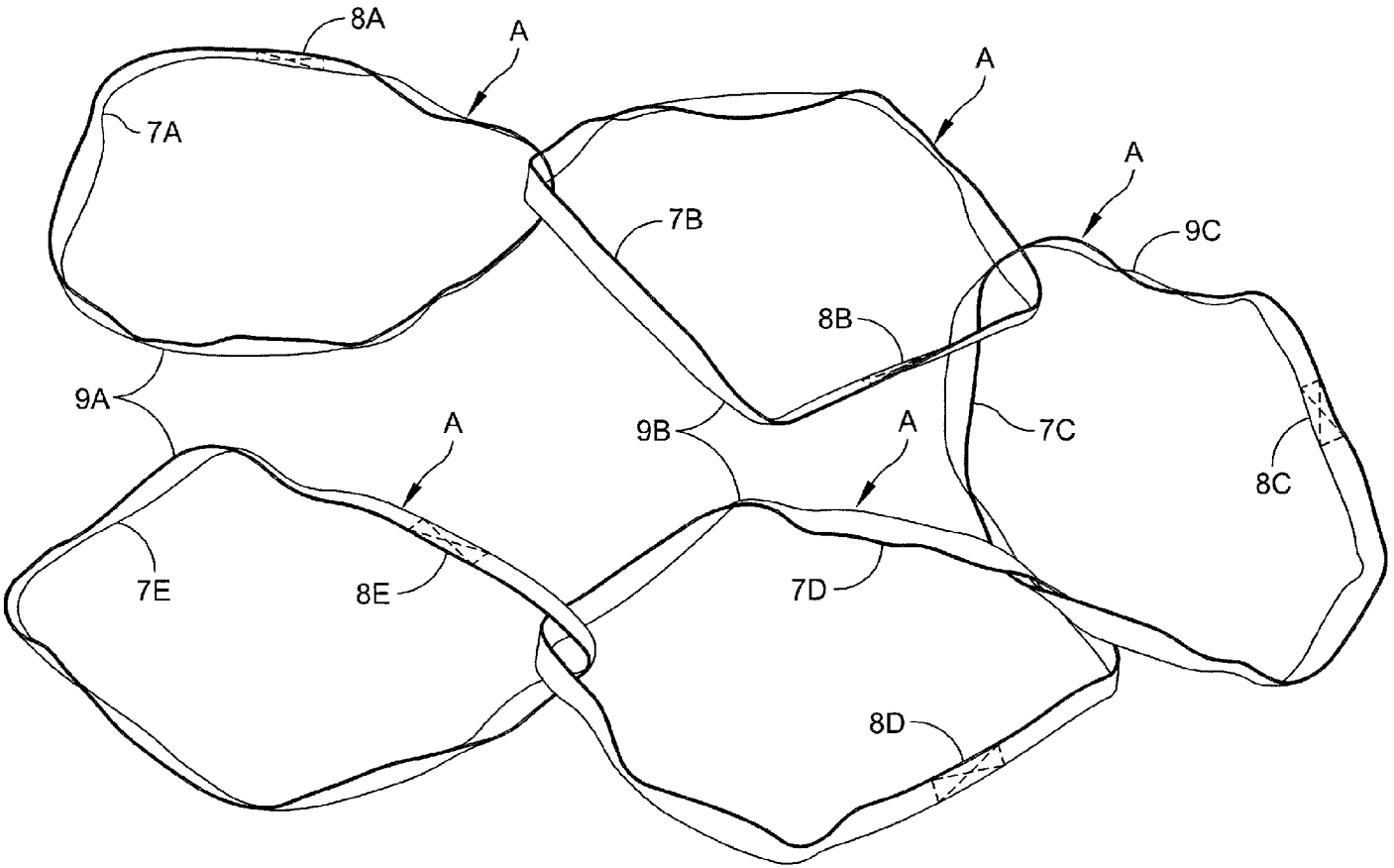
FIG. 1 (PRIOR ART)
FIG. 1 is a perspective schematic view illustrating the use of a typical prior art rescue sling constructed of a webbing material.
Figure 2:
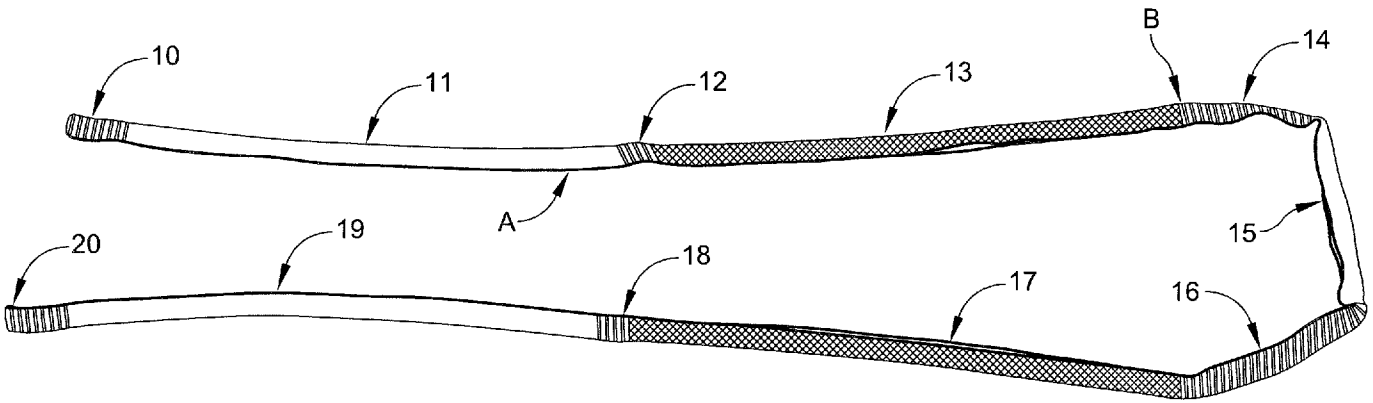
FIG. 2 is a perspective plan view of a rescue sling constructed in accordance with the principles of the present invention.

FIG. 2 illustrates rescue sling B constructed in accordance with the principles of the present invention containing preferably a total of eleven distinct sections that are numbered as sections 10, 11, 12, 13, 14, 15, 16, 17, 18, 19 and 20, where sections 10, 12, 14, 16, 18 and 20 are non-slotted webbing using a self-interlocking weave in a striped pattern, as illustrated, and sections 11, 13, 15, 17 and 19 are woven using a slotted weave construction.

Figure 3:
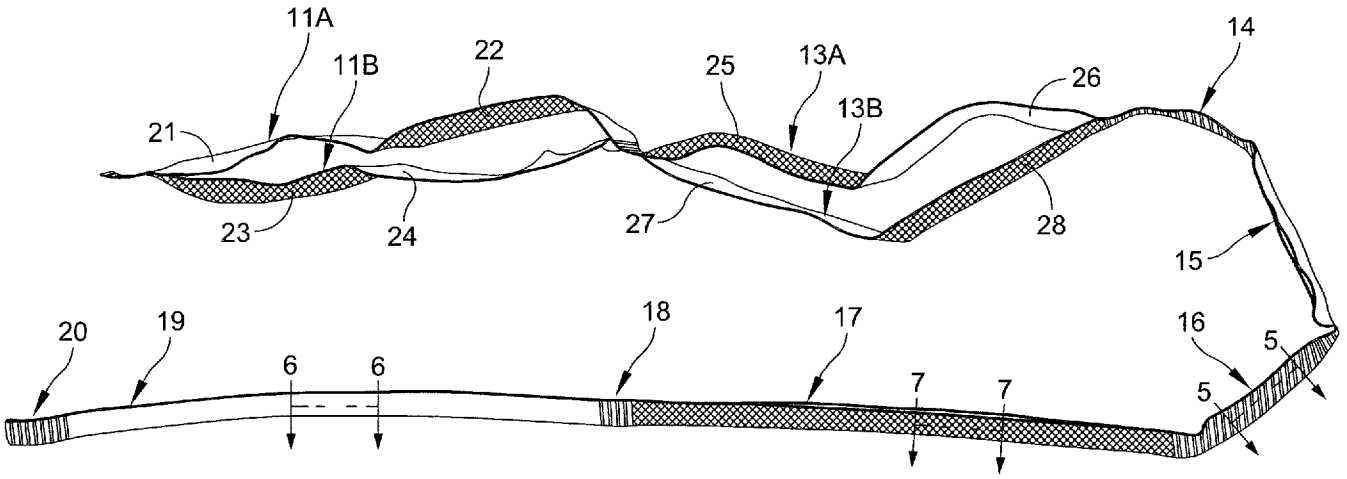
FIG. 3 is a perspective view of the rescue sling of FIG. 2 illustrating the four respective faces of the slotted weave portion of the rescue sling.

In FIG. 3 sections 11, 15 and 19 use a two ply slotted weave configuration where the top ply or piece 11A of the two ply slotted weave has a top side face 21 (un-hatched) which may be yellow in color with black edges, and the top ply slotted weave has a bottom side face 22 (hatched) which may be red in color with black edges. The bottom ply or piece 11B of the two ply slotted weave has a top side face 23 (hatched) which may be red in color with black edges, and the bottom ply of the two ply slotted weave has a bottom face 24 (un-hatched) which may be yellow in color with black edges. Sections 13 and 17 also use a two ply slotted weave configuration where the top ply or piece 13A of the two ply slotted weave has a top side face 25 (hatched) which may be red in color with black edges and the bottom ply of the two ply slotted weave has a bottom face 26 (un-hatched) which may be yellow in color with black edges. The bottom ply or piece 13B of the two ply slotted weave configuration has the top side face 27 (un-hatched) which may be yellow in color with black edges and the bottom ply of the bottom face 28 (hatched) may be red in color with black edges. Thus, for the arrangement illustrated in FIG. 3 for sections 13 and 17 the outwardly facing surfaces are the same color; red in this instance, while for sections 11 and 19 the outwardly facing surfaces are the same color; yellow in this instance, and thus different than the outer facing surfaces of sections 13 and 17.

Figure 4:
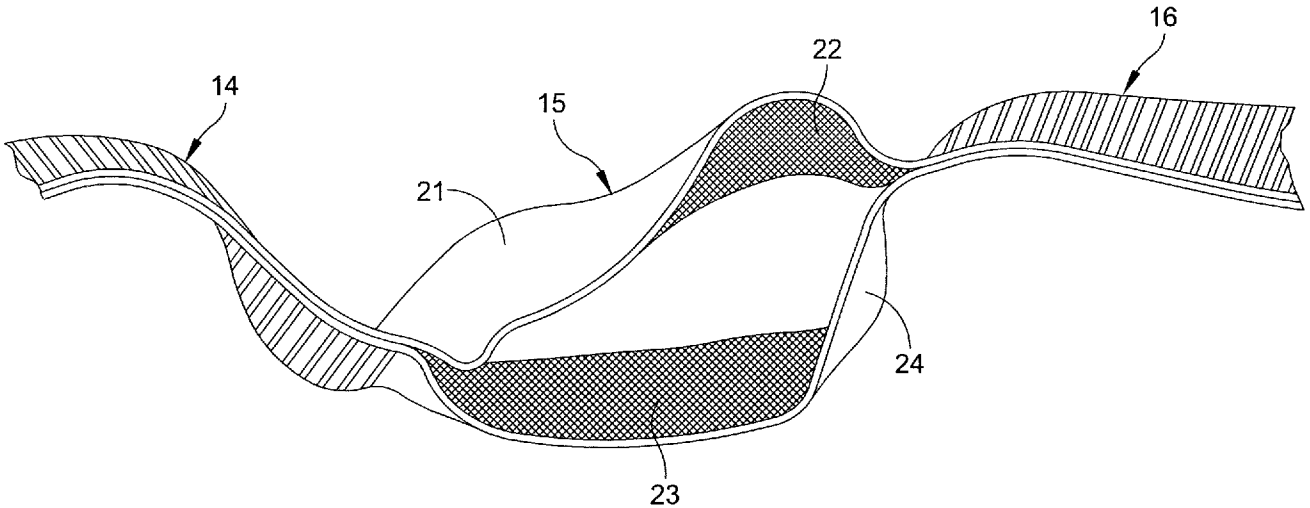
FIG. 4 is a perspective view of a middle slotted weave section that forms a hand hold in accordance with the present invention.
Figure 5:
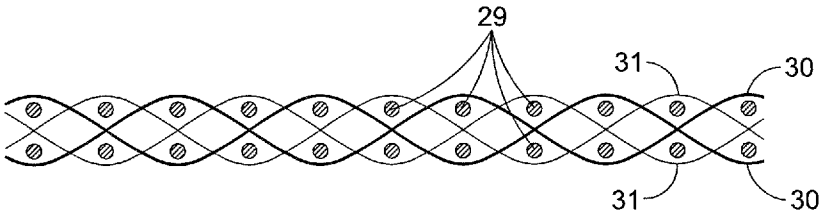
FIG. 5 is a sectional view through several of the non-slotted sections as taken along line 5-5 of FIG. 3.

FIG. 4 is a schematic perspective taken around section 15. This illustrates the shorter length two ply slotted weave configuration of section 15 showing a close up of what is illustrated in FIG. 3. This section 15 forms the handle loop for grasping by a rescuer. In FIG. 4 the section 15 is substantially the same as either section 11 or 19. Thus, FIG. 4 illustrates the color differences between the top and bottom plys 21, 22, 23, 24. The top ply or piece of the two ply slotted weave has a top side face 21 (un-hatched) which may be yellow in color with black edges, and the top ply slotted weave has a bottom side face 22 (hatched) which may be red in color with black edges. The bottom ply or piece of the two ply slotted weave has a top side face 23 (hatched) which may be red in color with black edges, and the bottom ply of the two ply slotted weave has a bottom face 24 (un-hatched) which may be yellow in color with black edges FIG. 5 is a schematic sectional view that is representative of any one of sections 10, 12, 14, 16, 18 and 20 and shown as taken along line 5-5 of FIG. 3. FIG. 5 shows the filling yarn 29

(circles) along with the self-interlocking weaves and how the stripped pattern of, for example, red yarns 30 and yellow yarns 31 is achieved using the self-interlocking weave sequence. This thus illustrates a non-slotted weave pattern. In FIG. 5, as well as in FIGS. 6 and 7, the thinner weave designation (31) is representative of one color such as yellow and the thicker weave designation (30) is representative of a different color such as red.

Figure 6:
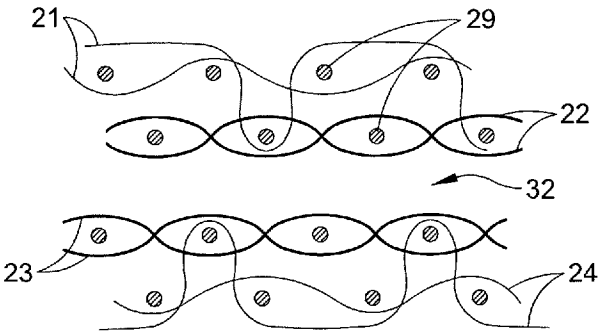
FIG. 6 is a sectional view through several of the first type of slotted section as taken along line 6-6 of FIG. 3.

FIG. 6 is a sectional view that is representative of any one of sections 11, 15 and 19 and taken along line 6-6 in FIG. 3. This shows top slot face yellow weave 21 and top slot bottom side face red weave 22, as well as bottom slot top face red weave 23 and bottom slot bottom face yellow weave 24 along with the formed slot opening 32.

Figure 7:
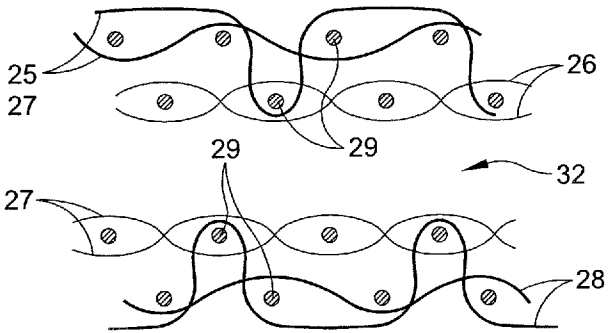
FIG. 7 is a sectional view through several of a second type of slotted section as taken along line 7-7 of FIG. 3.

FIG. 7 is a sectional view that is representative of any one of sections 13 and 17 and taken along line 7-7 in FIG. 3. This shows top slot face red weave 25 and top slot bottom side face yellow weave 26, as well as bottom slot top face yellow weave 27 and bottom slot bottom face red weave 28 along with the formed slot opening 32.

The weaving begins with section 10. The weave of section 10 is a self interlocking two ply weave where the black solution dyed yarns weave along both edges and the red and yellow yarns weave the body of the webbing. The appearance of the webbing is striped red and yellow from one edge to the other edge. This is accomplished by programming the loom so half of the red yarns weave over pick number 1 on the face of the webbing and under pick number 3 on the back of the webbing. This sequence repeats every 4 picks to the end of section 10. The other half of the red yarns weave over pick number 3 on the face of the webbing and under pick number 5 on the back of the webbing. This sequence also repeats itself every 4 picks to the end of section 10. Half of the yellow yarns weave over pick number 2 on the face of the webbing and under pick number 4 on the back of the webbing. This sequence repeats every 4 picks to the end of section 10. The other half of the yellow yarns weave over pick number 4 on the face of the webbing and under pick number 2 on the back of the webbing. This sequence also repeats itself every 4 picks to the end of section 10. The filling yarn is solution dyed black and is inserted at approximately 18 yarns per linear inch. The length of section 10 may be about 3" long or 54 picks.

Section 11 is woven with a slotted weave design. It may use black warp yarns weaving on both edges of the top and bottom slot. The top slot piece is woven using a 3 up 1 down weave and a 1 up 3 down weave without reference to the bottom slot piece. The top slot piece is woven with ½ of the total number of yellow yarns showing just on the top face of the webbing. The bottom face of the top slot piece is woven with ½ of the total number of red ends showing just on the bottom face of the top slot piece. The bottom slot piece is also woven using a 3 up 1 down weave and a 1 up 3 down weave without reference to the top slot piece. The bottom slot piece is woven with the other half of the total number of red ends showing just on the top face of the webbing. The bottom face of the bottom slot piece is woven with the other half of the yellow ends showing just on the bottom face of the bottom slot piece. The filling yarn is solution dyed black and is inserted at approximately 36 yarns per linear inch. This increase in pick level is achieved with a pick interrupter which slows the speed of the take down rolls of the loom which yields a higher pick count. The length of section 11 is approximately 24 inches long or 896 picks.

Section 12 uses the same weave design (stripped) as section 10. The only difference is the length is changed to ¾ inch or 12 picks.

Section 13 is woven with a slotted weave design. The weave may be identical to section 11 with the exception of the red and yellow weaves swapping positions. It uses black warp yarns weaving on both edges of the top and bottom slot piece. The top slot piece is woven using a 3 up 1 down weave and a 1 up 3 down weave without reference to the bottom slot piece. The top slot piece is woven with ½ of the total number of red yarns showing just on the top face of the webbing. The bottom face of the top slot piece is woven with ½ of the total number of yellow ends showing just on the bottom face of the top slot piece. The bottom slot piece is also woven using a 3 up 1 down weave and a 1 up 3 down weave without reference to the top slot piece. The bottom slot piece is woven with the other half of the total number of yellow ends showing just on the top face of the webbing. The bottom face of the bottom slot piece is woven with the other half of the red ends showing just on the bottom face of the bottom slot piece. The filling yarn is solution dyed black and is inserted at approximately 36 yarns per linear inch. This increase in pick level is achieved with a pick interrupted which slows the speed of the take down rolls of the loom which yields a higher pick count. The length of section 13 is approximately 24 inches long or 896 picks Section 14 uses the same weave design (stripped) as section 10. The only difference is the length is changed to approximately 12 inches or 108 picks.

Section 15 uses the same weave configuration as section 11. The filling yarn is solution dyed black and is inserted at approximately 36 yarns per linear inch. This increase in pick level is achieved with a pick interrupter which slows the speed of the take down rolls of the loom which yields a higher pick count. The length of section 15 is approximately 6 inches long or 208 picks.

Section 16 may be identical to section 14 in every respect. Section 17 is preferably identical to section 13 in every respect. Section 18 is preferably identical to section 12. Section 19 is preferably identical to section 11 in every respect. Section 20 is preferably identical to section 10 in every respect.

The completed sling with the 11 sections represent the rescue sling. The bitter ends of sections 10 and 20 can be folded over on each other and sewn to form a neat termination, or the bitter ends may be left free. Epoxy resin or similar materials can also be used to terminate the bitter end. A plastic or metal clasp can also be used at the bitter ends.

One method of use is to place the sling on an individual in the following manner. The person being rescued will have their legs placed into the slot portion of section 11 and section 19. The arms are placed in the slot portion of section 13 and section 17. Sections 14, 15 and 16 are placed behind the wearers neck with section 15 being utilized as a handle to drag or lift the individual from harms way.

Having now described a limited number of embodiments of the present invention, it should now become apparent to those skilled in the art that numerous other embodiments and modifications thereof are contemplated as falling within the scope of the present invention as defined in the appended claims. Examples of modification would be that a slightly smaller sling may be contemplated using a single grasping loop and just two larger open loops which could be used to receive, for example, the arms of one being rescued. Also, the length of the non-slotted portions particularly between open loops may be minimized as long as the preferred arm and leg loops are formed. Many different types of weaves may be employed to form both non-slotted sections and slotted sections.

What is claimed is:

1. A rescue sling comprising multiple elongated webbing sections including contiguous alternating slotted and non-slotted webbing sections, one of said slotted webbing sections forming a handle opening meant to be grasped by a rescuer, and at least two other slotted webbing sections oppositely coupled from opposed ends of the at least one slotted webbing section and forming respective retaining openings for receiving therethrough limbs of one being rescued, said at least two slotted webbing sections each having a slot length that is greater in length than a slot length of the one slotted webbing section.

2. The rescue sling of claim 1 including two additional slotted webbing sections disposed distally of the respective at least two slotted webbing sections and forming respective additional retaining openings for receiving therethrough additional limbs of the one being rescued.

3. The rescue sling of claim 2 wherein the slotted webbing sections are color coded.

4. The rescue sling of claim 3 wherein each of the sections of slotted webbing is comprised of separated webbing pieces that each have an inside surface and an outside surface.

5. The rescue sling of claim 4 wherein, for each webbing piece of a webbing section, the colors differ on the respective inside and outside surface thereof.

6. The rescue sling of claim 5 wherein the outside surface of the at least two other slotted webbing sections has a different color to that of the outside surface of the two additional slotted webbing sections.

7. The rescue sling of claim 5 wherein the different colors are red and yellow.

8. The rescue sling of claim 5 wherein the inside surface of the at least two other slotted webbing sections has a different color to that of the inside surface of the two additional slotted webbing sections.

9. The rescue sling of claim 5 wherein each non-slotted section is comprised of an interlocking two-ply weave.

10. The rescue sling of claim 9 wherein the non-slotted section is comprised of black solution dyed yarns weave along both edges and with red and yellow yarns weaving the body of the webbing.

11. The rescue sling of claim 5 wherein the handle opening is smaller than the retaining openings.

12. A rescue sling comprising multiple elongated webbing sections including contiguous alternating slotted and non-slotted webbing sections, one of said slotted webbing sections forming a handle opening meant to be grasped by a rescuer, and at least two other slotted webbing sections oppositely coupled from the at least one slotted webbing section and forming respective retaining openings for receiving therethrough limbs of one being rescued, wherein each of the sections of slotted webbing is comprised of separated top and bottom webbing pieces that each have a top face and a bottom face, and wherein the top webbing piece is woven using a 3 up 1 down weave and a 1 up 3 down weave without reference to a bottom piece, the top webbing piece is woven with ½ of the total number of yarns showing just on the top face of the webbing, and the bottom face of the top piece is woven with ½ of the total number of ends showing just on the bottom face of the top piece.

13. The rescue sling of claim 12 wherein the bottom webbing piece is also woven using a 3 up 1 down weave and a 1 up 3 down weave without reference to the top piece; the bottom webbing piece is woven with the other half of the total number of ends showing just on the top face of the webbing; and the bottom face of the bottom piece is woven with the other half of the ends showing just on the bottom face of the bottom piece.

14. A rescue sling comprising:

a first non-slotted webbing section;
a second slotted webbing section;
a third non-slotted webbing section;
a fourth slotted webbing section;
a fifth non-slotted webbing section;
a sixth slotted webbing section;
a seventh non-slotted webbing section;
an eighth slotted webbing section;
a ninth non-slotted webbing section;
a tenth slotted webbing section; and
an eleventh non-slotted webbing section;
all said webbing sections being contiguously interconnected in sequence from the first non-slotted webbing section to the eleventh non-slotted webbing section.

15. The rescue sling of claim 14 wherein each of the sections of slotted webbing is comprised of separated webbing pieces that each have an inside surface and an outside surface.

16. The rescue sling of claim 15 wherein the slotted webbing sections are color coded.

17. The rescue sling of claim 16 wherein, for each webbing piece of a webbing section, the colors differ on the respective inside and outside surface thereof.

18. The rescue sling of claim 17 wherein the outside surface of the second slotted webbing section has a different color to that of the outside surface of the fourth slotted webbing section.

19. The rescue sling of claim 18 wherein the inside surface of the second slotted webbing section has a different color to that of the inside surface of the fourth slotted webbing sections.

20. The rescue sling of claim 14 wherein the second, fourth, eighth and tenth webbing sections form respective retaining openings for receiving therethrough limbs of one being rescued, and the sixth webbing section forms a handle opening meant to be grasped by a rescuer.

21. A method of forming a rescue sling comprising providing multiple elongated webbing sections including contiguous alternating slotted and non-slotted webbing sections, one of said slotted webbing sections forming a handle opening meant to be manually grasped by a rescuer, and at least two other slotted webbing sections oppositely coupled from the at least one slotted webbing section and forming respective retaining openings for receiving therethrough limbs of one being rescued, said one of said slotted webbing section forming the handle having a slot length that is shorter than a slot length of either of the two other slotted webbing sections.

22. The method of claim 21 including providing two additional slotted webbing sections disposed distally of the respective at least two slotted webbing sections and forming respective additional retaining openings for receiving therethrough additional limbs of the one being rescued.

23. A rescue sling comprising multiple elongated webbing sections including contiguous alternating slotted and non-slotted webbing sections, one of said slotted webbing sections forming a handle opening meant to be grasped by a rescuer, and two other slotted webbing sections oppositely coupled from opposed ends of the one slotted webbing section by way of respective non-slotted webbing sections, said two other slotted webbing sections forming respective retaining openings for receiving therethrough limbs of one being rescued, said two other slotted webbing sections each having a slot length that is greater in length that a length of the respective non-slotted webbing sections.

24. The rescue sling of claim 23 including two additional slotted webbing sections disposed distally of the respective at least two slotted webbing sections and forming respective additional retaining openings for receiving therethrough additional limbs of the one being rescued.

25. The rescue sling of claim 24 wherein the non-slotted webbing sections include respective intercoupling non-slotted webbing sections disposed each between one of the at least two slotted webbing sections and one of the two additional slotted webbing sections.

26. The rescue sling of claim 25 wherein each of the intercoupling non-slotted webbing sections has a length substantially less than the length of any one of the slotted webbing sections.

27. The rescue sling of claim 26 including two further non-slotted webbing sections attached to respective free ends of the two additional slotted webbing sections.

* * * * *